US006896492B2

(12) United States Patent
Masterton

(10) Patent No.: US 6,896,492 B2
(45) Date of Patent: May 24, 2005

(54) MAGNETICALLY DRIVEN AIR MOVING APPARATUS, WITH MAGNETICALLY TIPPED FAN BLADES AND A SINGLE FIELD COIL AND CORE

(75) Inventor: Patrick Masterton, Carol Stream, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/229,805

(22) Filed: Aug. 28, 2002

(65) Prior Publication Data

US 2004/0042916 A1 Mar. 4, 2004

(51) Int. Cl.[7] ..... F04B 17/03

(52) U.S. Cl. ..... 417/356; 417/355; 417/423.1; 417/423.7; 417/423.14; 310/63; 310/254; 310/686; 361/688; 361/701

(58) Field of Search ..... 417/355, 356, 417/423.1, 423.7, 423.14; 310/63, 254, 686; 361/688, 701

(56) References Cited

U.S. PATENT DOCUMENTS 4,459,087 A * 7/1984 Barge ..... 417/356
4,553,075 A * 11/1985 Brown et al. ..... 318/254
4,618,806 A * 10/1986 Grouse ..... 318/254
4,949,022 A * 8/1990 Lipman ..... 318/254
4,953,811 A * 9/1990 Smith ..... 244/17.19
5,075,606 A * 12/1991 Lipman ..... 318/254
5,379,999 A * 1/1995 Barzideh et al. ..... 271/264
5,616,974 A * 4/1997 Yamada ..... 310/68 B
6,194,798 B1 * 2/2001 Lopatinsky ..... 310/63
6,388,346 B1 * 5/2002 Lopatinsky et al. ..... 310/63
6,527,522 B2 * 3/2003 Chen ..... 417/355
6,606,578 B1 * 8/2003 Henderson et al. ..... 702/145
6,670,737 B2 * 12/2003 Chen ..... 310/254

* cited by examiner

*Primary Examiner*—Cheryl Tyler
*Assistant Examiner*—Emmanuel Sayoc

(57) ABSTRACT

An improved air moving device that is scalable for use in a variety of applications requiring different fan sizes. The fan includes a number of fan blades, each having a discrete magnet mounted thereon. The orientation of each magnet is such that the direction of the magnetic field alternates from one blade to the next. The outside edge of each blade is metalized in a way that the magnetic field is present across the entire outer edge of the fan blade. In an alternate embodiment the fan blade assembly includes fan blades fabricated of a ferrous material in which the tips of the blades are magnetized through exposure to a strong magnetic field after fabrication of the blade assembly. The configuration of the blades in both embodiments enables the differential in field strength to assist with the rotation of the fan blades.

12 Claims, 3 Drawing Sheets

MAGNETICALLY DRIVEN AIR MOVING APPARATUS, WITH MAGNETICALLY TIPPED FAN BLADES AND A SINGLE FIELD COIL AND CORE

FIELD OF THE INVENTION

The present invention relates generally to an air moving apparatus and, more particularly, to a fan for cooling electronic equipment with improved reliability and increased scalability.

BACKGROUND OF THE INVENTION

A wide variety of equipment and systems, such as portable and desktop computers, mainframe computers, communication infrastructure frames, automotive equipment, etc., include heat-generating components in their casings. As increasingly dense and higher performance electronics are packaged into smaller housings, the need for effective cooling systems is paramount to prevent failure of such sensitive electronics devices. One method used to remove heat from such equipment is to have an axial fan draw air from the exterior, of the casing to blow cooling air over the heat-generating components. However, as the number of electronics devices in offices and households increases, so too does the number of cooling fans. As such, fan noise becomes significantly loud and undesirable.

Typically, known fan assemblies include a fan blade structure, fan housing and a discrete motor. The fan motor is centrally mounted to the housing and the fan blade assembly is attached to the shaft of the motor. These types of fan assemblies are susceptible to a variety of failures. For example, the reliability of the motor used in the fan assembly may be compromised due to the heat generated by the motor or the heat of the surroundings in which the motor operates. Similarly, the heat affecting the motor also may affect the life of the fan bearings, resulting in premature failure of the fan. Another disadvantage of existing fan assemblies is the noise generated by these devices. As the density of electronics devices increases and as increasing numbers of transistors are packed into CPU cores, increased cooling becomes paramount. Generally such increased cooling comes at cost in the form of increased noise. Fans may be required to be bigger, thereby requiring noisier higher torque motors. Or, higher rotational speeds may be required, resulting in noisier motors. Alternatively, multiple fans may be used, which also results in increased noise due to the multiple motors in operation.

DETAILED DESCRIPTION

The present invention is directed to an improved air moving device, such as a fan, that is scalable for use in a variety of applications requiring different fan sizes. In a first embodiment, the fan includes a number of fan blades, each having a discrete magnet mounted thereon. The orientation of each magnet is such that the direction of the magnetic field alternates from one blade to the next. Furthermore, the outside edge of each blade is metalized in a way that the magnetic field is present across the entire outer edge of the fan blade. In another embodiment, the fan blade assembly includes fan blades fabricated of a ferrous material in which the tips of the blades are magnetized through exposure to a strong magnetic field after fabrication of the blade assembly. Advantageously, in both embodiments, the configuration of the blades is such that that the differential in field strength assists with the rotation of the fan blades.

In each embodiment described above, the fan housing includes a field coil, which is integrated into the fan housing. The core of the field is constructed of a flexible laminate that allows it to be placed around the circumference of the housing after the windings have been attached. A particular advantage of the present embodiment is that only a single coil is needed, rather than two or more, for operating the magnetic fan. Additional coils may be added, but are not necessary, thereby reducing the cost and weight of the fan.

Figure 1:
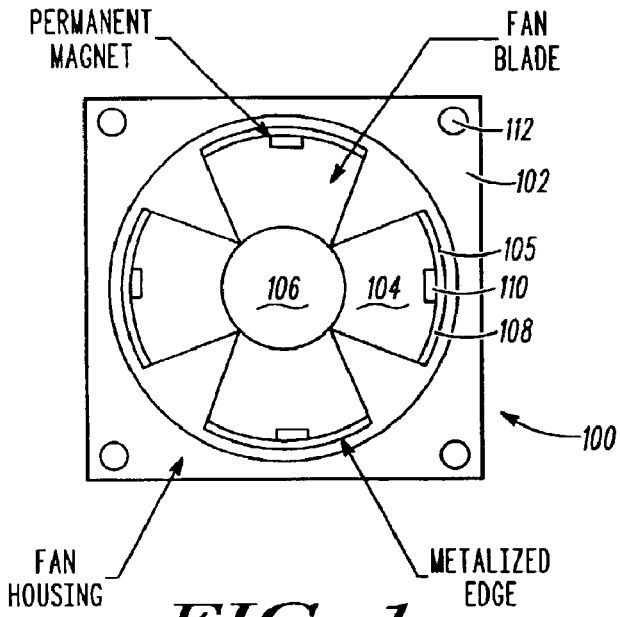
FIG. 1 is a front view of an air moving apparatus in accordance with the present invention showing a tube axial fan including fan blades with metalized edges and permanent magnets mounted thereon.

Referring to FIG. 1, there is illustrated an air moving apparatus 100 in the form of a fan 105 mounted in a housing 102 having through-holes 112 for receiving a screw or other fastening device for mounting purposes. The fan 105 includes a hub 106. Not shown is the center of the hub 106 mounted on one end of a ball-bearing axle and the other end of the ball-bearing axle mounted in a holder in the center of the fan housing 102 to provide an axis of rotation. Several fan blades 104*a*–104*d* are mounted evenly around the hub 106. Each fan blade 104*a*–104*d* is formed or mounted with a metalized strip 108*a*–108*d* that extends the entire length of the outside edge of the fan blade. A discrete permanent magnet 110*a*–110*d* is mounted on each fan blade 104*a*–104*d* such that the magnetic field created by the magnet 110*a*–110*d* is present through the metalized strip 108*a*–108*d*. Each magnet 110*a*–110*d* is oriented such that the direction of the magnetic field alternates between successive blades. In an alternate embodiment, the fan blades 104*a*–104*d* are formed using a ferrous material where the tips of the fan blades are magnetized through exposure to a strong magnetic field after the blade assembly is fabricated. A particular advantage of such an embodiment is the reduced cost realized from eliminating the need for mounting discrete magnets and metalized strips on each fan blade.

Figure 2:
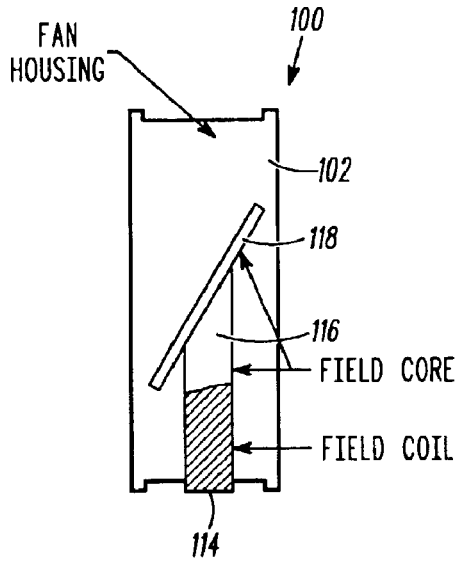
FIG. 2 is a side cross-sectional view of a fan housing showing the field coil and field core in accordance with the present invention.
Figure 3:
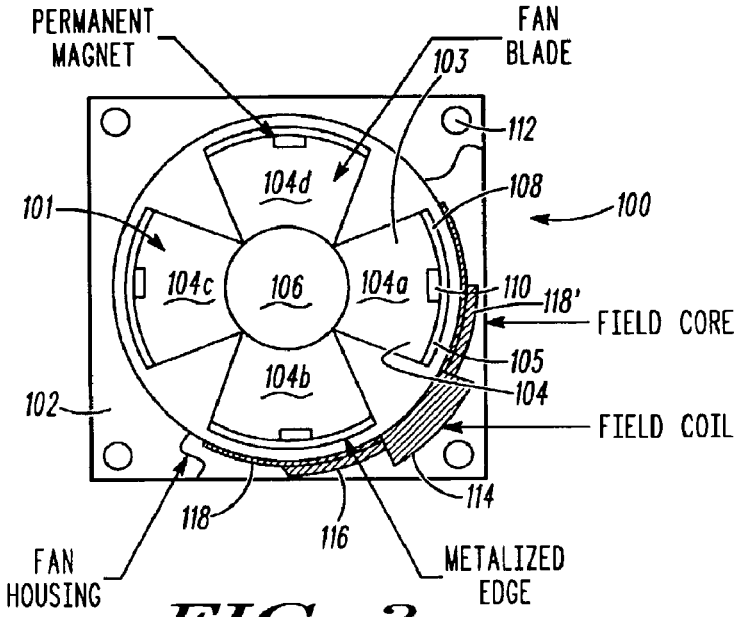
FIG. 3 is a front cross-sectional view of the air moving apparatus of FIG. 1 showing the field coil and field core in accordance with the present invention.

Referring to FIG. 2, the air moving apparatus 100 is illustrated from the side. As shown, the housing 102 is formed or molded with an aperture for housing an integrated field core 116 and a field coil 114. The field core 116 is constructed from a flexible laminate material around which the windings of the field coil 114 are wound. The field core 116 includes two faces 118, 118' (FIG. 3). Using the flexible laminate material allows the field core 116, 118 to be placed around the circumference of the housing 102 after the windings have been attached.

FIG. 3, more clearly illustrates the orientation of the field coil 114 and field core 116 and field core faces 118, 118' within the housing 102. In particular, the field core faces 118, 118' are oriented inwards toward the outer edges of the fan blades 104*a,* 104*b*. The length, pitch and curvature of the field core faces 118, 118' are such that the field core extends from just past the leading edge of one fan blade 104*a* to just past the trailing edge of the adjacent fan blade 104*b*. Further, the field core pitch is such that there is a continuous magnetic field between the fan blades. Power is supplied to the field coil 114 through wire leads (not shown) leading to the field coil 11. This 4creates an electromagnetic circuit for use in powering the fan 105. The higher the current through the field coil 114, the stronger the magnetic field is. Thus, the rotational speed of the fan 105 is adjusted by adjusting the voltage supplied to the field coil 114. A particularly effective voltage range is between 20VDC and 32VDC. The voltage may also be scaled down to 12VDC for use in personal computers as case fans or CPU and/or chipset cooling fans.

Known DC motors typically include a stator, rotor assembly, rotor position sensor and a commutation control chip. The stator is a wound, stationary set of electromagnets typically connected to the fan housing. The rotor assembly includes an iron core with permanent magnetic poles that is assembled into the hub of the fan. The rotor assembly is attached to an axle that rides on a pair of bearings in the fan frame to allow the rotor's permanent magnets to rotate freely around the outside of the stator. A known Hall-effect device is used to sense the rotor position. The commutation control chip uses the signal from the Hall-effect device to time the switching of each stator phase. Thus, a rotating electromagnetic field is established around the stator. Accordingly, the rotor is set in motion by the magnetic coupling between the rotating electromagnetic field and the magnetic pole.

Although the present invention is unique in its configuration and construction, and differs significantly from the fans found in the art, for ease of understanding certain parallels maybe drawn between existing fan designs and the present invention. For example, referring once again to FIG. 3, the housing 102 of the present invention having the mounted field coil 114 and field core 116 maybe considered the stator of the conventional motor. Similarly, the fan blades 104*a*–104*d* having the magnetized tips maybe considered the poles of a conventional motor. Thus, the number of fan blades in the present invention generally corresponds to the number of poles in the conventional motor. A Hall-effect sensor (not shown) is mounted at a 90 degree orientation from the electromagnetic circuitry. The Hall-effect sensor causes a particular polarity through the field core faces 118, 118' that is used to attract the first fan blade 104*a* and also is used to detect the next fan blade 104*b*. The polarity may then be switched to repel the first fan blade and attract the next fan blade.

Figure 4:
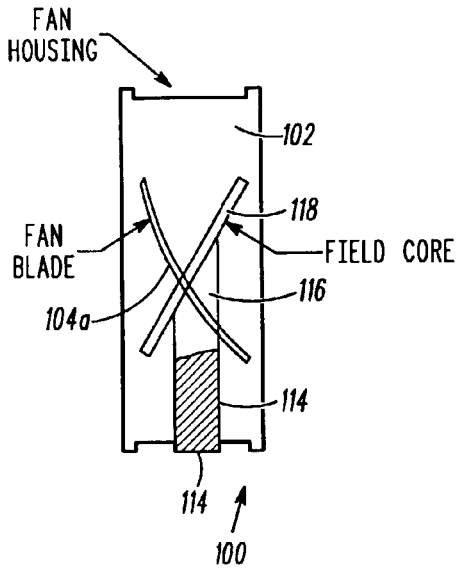
FIG. 4 is a side cross-sectional view of the fan housing showing the field coil, field core and blade in accordance with the present invention.
Figure 5:
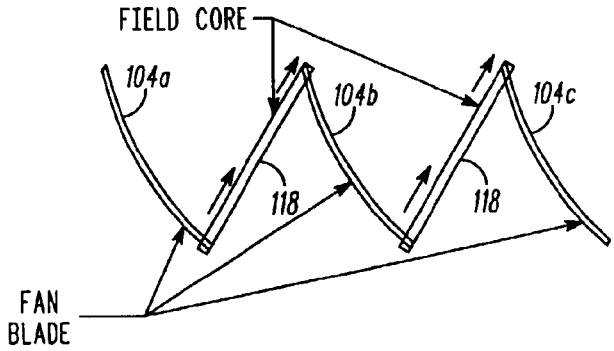
FIG. 5 is an operational state diagram of the fan with the blades in motion in accordance with the present invention.

Referring to FIGS. 4–5, the operation of the fan in the present invention is shown in detail. As illustrated, the fan housing 102 includes the integrated field core face 118, field core 116 and field coil 114. A voltage source (not shown) provides a pulse to the field coil 114. The pulse causes magnetic attraction of the fan blade 104*a* to the center of the field core face 118. As the fan blade 104*a* approaches the center of the field core face 118, the Hall-sensor determines the position of the blade 104*a*. As shown in FIG. 5, as the blade 104*a* approaches the field core face 118 and is attracted to its center, the Hall-sensor causes the polarity of the field core 116 to be switched, or reversed. As such, the blade 104*a* that is directly in front of the field core face 118 and was previously attracted to the center of the field core face 118 is now repelled away from the field core face 118 and the next, or adjacent, fan blade 104*b* is attracted to the center of the field core face 118. This process repeats for fan blade 104*c* and subsequent fan blades, thereby causing the fan 105 to rotate. Increasing the strength of the pulse by using a larger voltage source creates a stronger magnetic field in the field core. This increases the rotational speed of the fan. Furthermore, the magnetic field is stronger towards the middle of the fan edge and the field core and weaker on the perimeter. The differential in the field strength assists with the rotation of the fan. Alternatively, tapering the edge of the fan blade with respect to the housing also may be used to create a similar differential in field strength.

Figure 6:
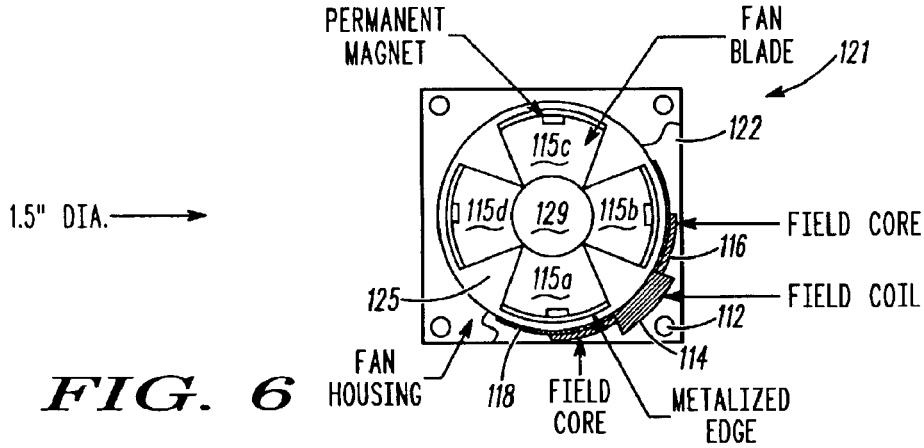
FIGS. 6–8 show multiple front cross-sectional views of fan housings of varying sizes showing the field coil and field core in accordance with the present invention.
Figure 7:
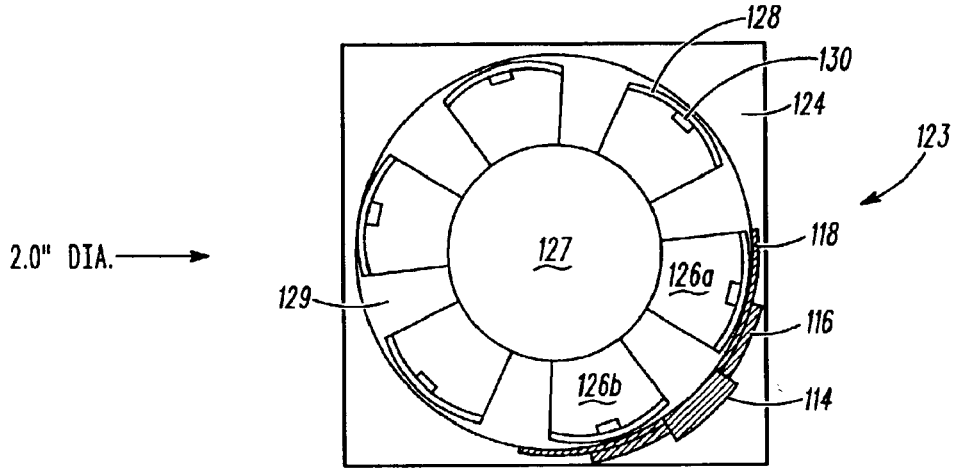
Figure 8:
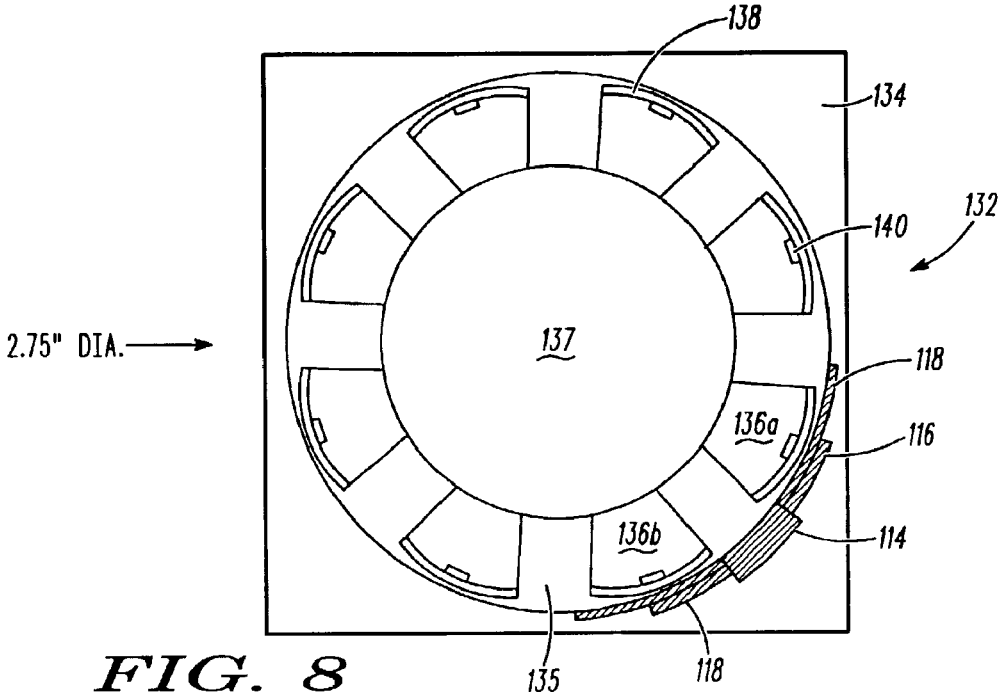

Another advantage of using the flexible laminate is that the same field core 116, 118 can be used for a variety of different fan sizes, as illustrated in FIGS. 6–8. Thus, increased scalability is gained by enabling the same field core to be used, for example, in micro fans for small electronics devices to large fans for cellular base stations.

Referring to FIG. 6, the present invention is shown in an embodiment wherein the air moving device 101 includes a housing 122 for housing a fan 125, for example, that is 1.5 inches in diameter. The fan 125 is configured with a hub 129 and four fan blades 115*a*–115*d*. The fan housing 122 is formed with the same electromagnetic circuitry having field core 116, field core face 118 and field coil 114 assembly, as described above. As shown, the fan blades are sized such that two fan blades 115*a,* 115*b* are within the span of the field core 116 and field core face 118. Accordingly, the operation of the fan is substantially similar to that described above.

Turning now to FIG. 7, the same electromagnetic circuitry is shown as being used once again in an air moving device 123. In this example, however, the fan 129 is two inches in diameter and is installed in a correspondingly larger housing 124. As shown, to enable a configuration where two fan blades 126*a*–126*b* are within the span of the field core 116 and field core face 118, the hub 127 is increased in diameter so that there is little change in the blade size. It is to be noted that alternative configurations of the fan are possible where only two fan blades fall within the electromagnetic circuitry.

Referring to FIG. 8, an exemplary air moving device 132 having a fan 135 that is 2.75 inches in diameter is shown. As illustrated, the hub 137 is increased in size even further relative to the previously described fans. By doing so, once again only two fan blades 136*a* and 136*b* fall within the span of the field core 116 and field core face 118.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. An air moving apparatus comprising:

a housing;

a rotatable hub that rotates in a predetermined rotary direction for providing airflow out of the housing;

a plurality of blades each extending radially from the hub to a distal, magnetic tip end portion thereof with the distal tip end portions being circumferentially spaced and disconnected from each other;

leading and trailing edges of each of the blades with the leading edge of one of the blades being spaced by a predetermined first circumferential distance from the trailing edge of another one of the blades adjacent to and trailing the one blade in the rotary direction; and a field coil mounted to the housing and including a core extending for a predetermined second circumferential distance about the tip end portions with the second circumferential distance being greater than the first circumferential distance.

2. The air moving apparatus of claim 1, wherein the core is a flexible laminate for enabling the field core to be placed around a circumference of the fan housing subsequent to the mounting of the coil.

3. The air moving apparatus of claim 1, wherein the core is a flexible laminate for enabling the field core to operate with fans of various sizes.

4. The air moving apparatus of claim 1, further comprising a hall effect sensor for sensing the orientation of the magnetic field of the blades.

5. The air moving apparatus of claim 3, wherein the field of the coil is reversed when the hall effect sensor senses a reversal in the orientation of the magnetic field when an adjacent blade is detected.

6. The air moving apparatus of claim 1, wherein the magnetic tip end portion of each blade comprises a metalized strip and permanent discrete magnet mounted on the tip end portion for enabling the magnetic field to be present across the entire tip end.

7. The air moving apparatus of claim 1, wherein each fan blade is formed of a ferrous material and has a magnetized tip end portion.

8. An air moving apparatus comprising:

a fan housing;

a rotatable hub;

a plurality of blades adjacent each other mounted to the hub for rotation in a predetermined rotary direction about an axis of rotation to provide pressurized airflow out from the housing, each blade having a single magnetic tip end portion for producing a magnetic field across the outside edge of the blades, wherein each adjacent blade has an opposite magnetic orientation to the other, wherein the magnetic tip end portions are separate and non-continuous and wherein the magnetic tip end portions are formed in area substantially smaller than the area of the tip of the blade; and a single field coil having a flexible core mounted to the fan housing, wherein the flexible core of the single field coil extends slightly past a leading edge of a first blade and slightly past a trailing edge of an adjacent, trailing blade in the rotary direction such that only the single field coil need be employed to drive the plurality of blades.

9. The air moving apparatus of claim 8, further comprising magnetic circuitry integrated within said housing for attracting and repelling the plurality of blades to enable the fan blades to rotate about an axis of rotation.

10. The air moving apparatus of claim 9, wherein the core is a flexible laminate.

11. The air moving apparatus of claim 1 wherein the field coil comprises a single field coil which drives the blades for rotation in cooperation with the magnetic tip end portions thereof due to the greater second circumferential distance that the field coil core extends compared to the first circumferential distance between adjacent blades.

12. The air moving apparatus of claim 1 wherein the blades each include a body of magnetizable material, and the magnetic tip end portions of the blades are integrally formed from the magnetizable material of the blade bodies.

* * * * *